United States Patent [19]

Scheuchzer et al.

[11] 4,319,416

[45] Mar. 16, 1982

[54] METHOD FOR DRAINING A RAILWAY TRACK AND A RAILWAY TRAIN FOR USE IN SAID METHOD

[75] Inventors: Fredy Scheuchzer, Lausanne; Fritz Bühler, Ecublens, both of Switzerland

[73] Assignee: Les Fils d'Auguste Scheuchzer, S.A., Switzerland

[21] Appl. No.: 188,113

[22] Filed: Sep. 17, 1980

[30] Foreign Application Priority Data

Nov. 8, 1979 [EP] European Pat. Off. ..... 79810147.3

[51] Int. Cl.[3] ..... E01B 37/00; E01B 27/10

[52] U.S. Cl. ..... 37/104; 104/2; 104/12; 104/7 R

[58] Field of Search ..... 37/104–106; 104/2–5, 6, 7 R, 7 B, 12

[56] References Cited

U.S. PATENT DOCUMENTS

| | | | |
|---|---|---|---|
| 3,680,486 | 8/1972 | Plasser et al. | 104/12 X |
| 3,731,409 | 5/1973 | Schenkir et al. | 37/104 |
| 3,744,428 | 7/1973 | Plasser et al. | 104/12 |
| 4,160,418 | 7/1979 | Theurer | 104/2 |
| 4,207,820 | 6/1980 | Ciun-Sain | 104/2 |
| 4,211,170 | 7/1980 | Theurer | 104/2 |
| 4,249,467 | 2/1981 | Theurer et al. | 104/3 |
| 4,253,398 | 3/1981 | Theurer et al. | 104/2 |
| 4,257,331 | 3/1981 | Theurer et al. | 37/104 X |
| 4,261,264 | 4/1981 | Theurer et al. | 104/6 |
| 4,275,659 | 6/1981 | Theurer et al. | 104/2 |

FOREIGN PATENT DOCUMENTS

| | | | |
|---|---|---|---|
| 1534103 | 7/1969 | Fed. Rep. of Germany | 104/2 |
| 2732305 | 2/1978 | Fed. Rep. of Germany | 104/2 |
| 583822 | 1/1977 | Switzerland | 104/2 |
| 2004933 | 4/1979 | United Kingdom | 104/12 |

*Primary Examiner*—E. H. Eickholt

*Attorney, Agent, or Firm*—Robert E. Burns; Emmanuel J. Lobato; Bruce L. Adams

[57] ABSTRACT

A method for the improvement and drainage of a length of railway track employs a train to carry out the method whereby it is made possible to dismantle and reassemble the length of track together with its infrastructure. Ballast and earth are excavated from the track and replaced by a layer of sand which is distributed and compacted mechanically through an empty frame of a working truck of the train. Two travelling gantries are provided on the train and equipped both with a lifting device for a length of track and a lifting and tipping device for buckets. The working truck is also equipped with a strip for levelling a platform and a tamper. These two members are mounted on a common chassis supported by travelling on the two side parts of the empty frame of the working truck within the travelling supports for the gantries so that the levelling-tamping chassis may move freely by passing below the gantries.

4 Claims, 3 Drawing Figures

METHOD FOR DRAINING A RAILWAY TRACK AND A RAILWAY TRAIN FOR USE IN SAID METHOD

The invention relates to a method for improving the drainage of a railway track and a railway train for carrying out the method.

In certain terrains where it is difficult for water to drain, the stability of a railway track may be jeopardized by flooding. Tracks of this type must be drained by a permeable bed.

A known method of draining a railway track comprises the excavation of the ballast and the earth of the bed of the track to a depth which depends on the terrain and replacement of the materials excavated by a compacted layer of sand.

For correct distribution and compacting of the layer of sand, it is necessary to dismantle the old track completely.

Various trains are known comprising machines for the excavation of the ballast, its loading and its discharge, for example as described in Swiss Pat. Nos. 597,428 and 609,622, which can be used under the circumstances. An installation is also known for renewing the track, namely as described in Swiss Pat. No. 549,692. The train described by this latter patent comprises a continuous track for gantries provided with gear for lifting lengths of track and a truck composed of an empty frame through which it is possible to pass lengths of track.

This installation is not suitable for improving drainage of the track, nor is the renewal train described in Swiss Pat. No. 583,822. The design of this train makes it impossible to include operations for putting the layer of sand in place, which must be effected before the ballast is put in place.

It is apparent from this state of the art that the distribution and compacting of the sand and ballast are still carried out manually and by means of appliances which are ill-suited to this type of work. This method of working requires a high number of workers at the site and the output per hour is low. Furthermore, the present system of working requires the storage of the old and new sleepers on the site. Due to a lack of space, the sleepers are frequently stored in the area of the bed whereof the drainage is to be improved and consequently this part must be treated before or after improving the drainage of the remainder of the track.

At present, the work is carried out in the following manner by the following stages:

previous unloading of new sleepers onto the bed;

manual dismantling of the old sleepers and storage at the side of the track, the old sleepers being removed from the site;

excavation and loading of the ballast by means of machines;

assembly of a working track which rests on the bed through the intermediary of studs;

unloading of the trucks and manual distribution of the sand;

manual dismantling of the working track and of the support studs embedded in the sand;

compacting of the sand;

unloading an distribution of the ballast;

assembly of the new sleepers either manually or by means of lifting gear;

unloading and distribution of the complementary ballast; and assembly of the new track.

The present invention intends to remedy this state of affairs and provide a novel solution to the problem of improving the drainage of a railway track.

According to a first aspect of the present invention there is provided a method for improving the drainage of a length of railway track comprising the steps of excavating ballast and earth from the infrastructure of the track, replacing the excavated material by a layer of compacted sand and restoring the ballast so that the sand and ballast are distributed at the centre of the track, levelling and compacting the bed, sand and ballast mechanically through the empty frame of a working railway truck specifically equipped for this purpose, and reassembling the length of railway track.

According to a second aspect of the present invention there is provided a railway train for use in the method according to the first aspect of the invention comprising a first set of rail cars for travelling on the length of track to be drained, which first rail cars are equipped for excavation and evacuation of the bed of the length of track, and a second set of rail cars for travelling on track adjacent to said length, which second rail cars are equipped for conveying materials for the new bed and the new rails of the length of track and which set comprises a working truck composed of two bogies joined by an empty frame having a length which is greater than the length of a section of rail, one of the bogies being for travelling on said adjacent track and the other bogie being for travelling on said length of track, which working truck is connected to the trucks of the second set of rail cars by tracks for gantries, and two travelling gantries being provided and equipped both with a lifting device for a length of rail and a device for lifting and tipping buckets, and the working truck being equipped with a strip for levelling the bed and a tamper, these two latter pieces of equipment covering the entire width of the bed and being supported by travelling on the two side parts of the empty frame.

The advantages obtained by this invention are above all the speed at which the work advances, which is of prime importance for a railway track, a considerable reduction of workers on the site, greater regularity and better quality of the work carried out owing to the fact that the bed below the working truck is free of any obstacles, mechanical levelling of the track, and the fact that distribution, spreading and compacting of the sand and ballast may take place under optimum conditions.

The present invention will now be described by way of example with reference to the accompanying drawings in which.

Figure 1:
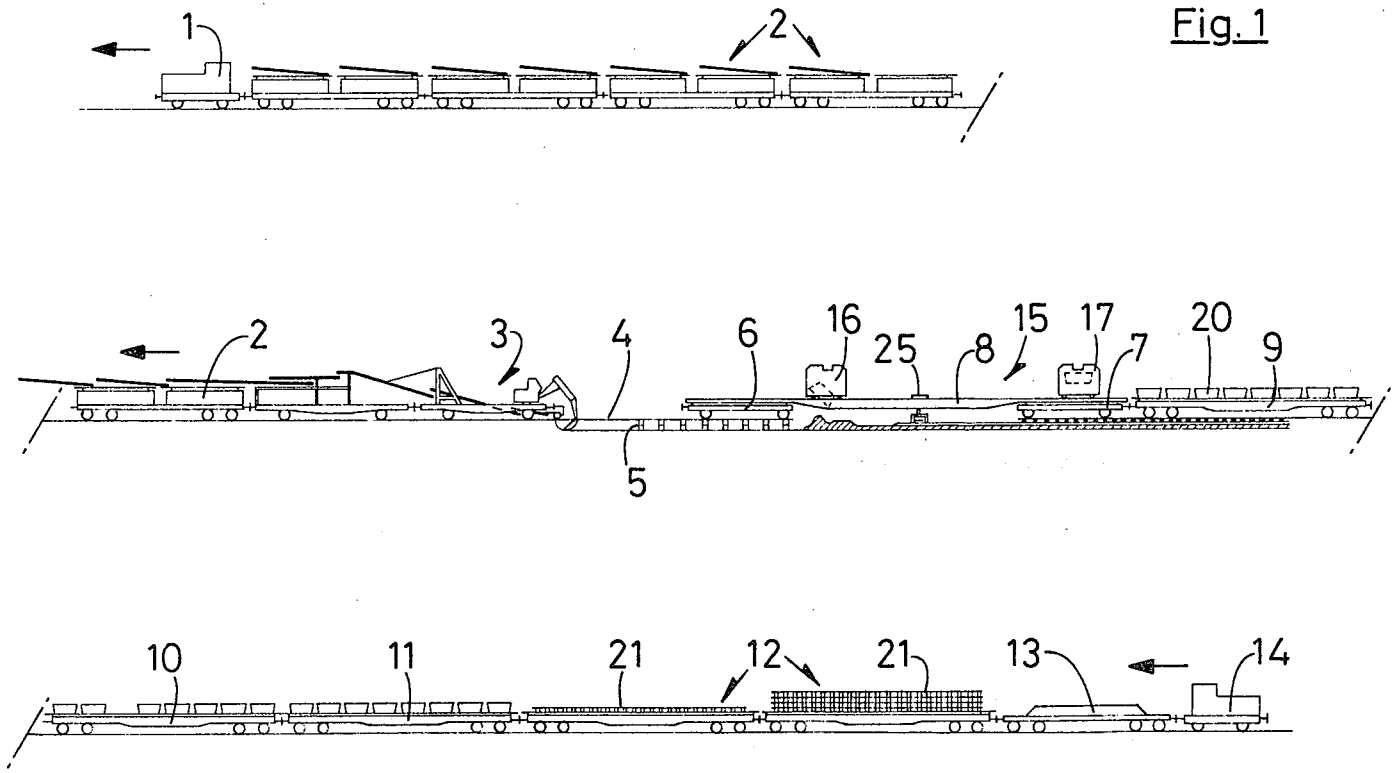
FIG. 1 is a diagrammatic general view of a train according to the present invention.

The train for improving drainage, shown diagrammatically in FIG. 1, is composed of a first set of rail cars which comprises the engine 1, trucks 2 for transporting excavated ballast as described in Swiss Pat. No. 609,622, and an excavation machine 3 as described in Swiss Pat. No. 597,428. This set of cars travels on a track, a so-called working track 4, provided with iron sleepers which can be easily dismantled. In order to compensate for the height of the ballast and of the bed which have been excavated, the rails 4 are placed on studs 5 at the point where a front bogie 6 of the working truck 15 travels.

The second set of cars comprises the working truck 15 composed of the bogies 6 and 7 and of an empty frame 8 provided with tracks extending onto the trucks of the second set of cars. This second set of cars comprises trucks 9 loaded with buckets of sand, trucks 10 loaded with empty buckets, trucks 11 loaded with ballast, trucks 12 loaded with pieces of track, trucks 13 loaded with complementary ballast and the engine 14.

Figure 2:
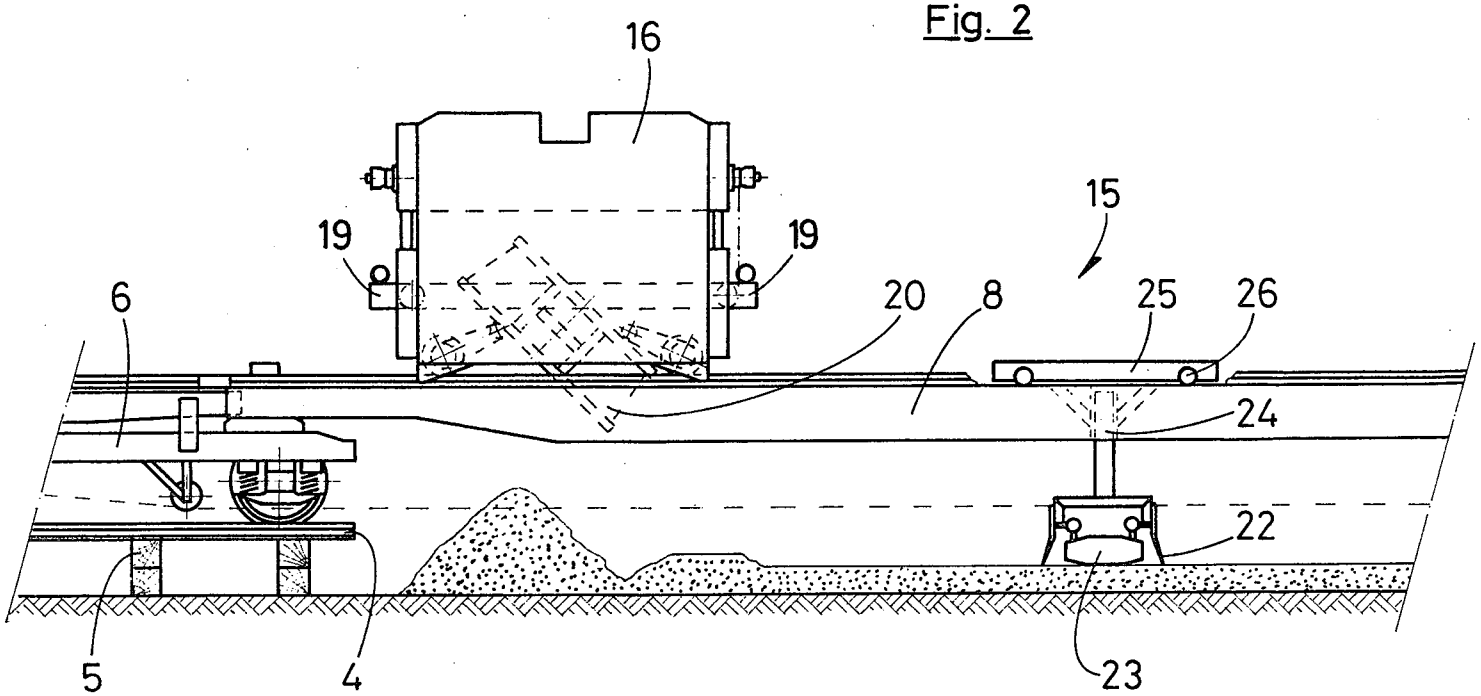
FIG. 2 shows a truck-frame of the train and ancilliary equipment, to an enlarged scale with regard to FIG. 1.
Figure 3:
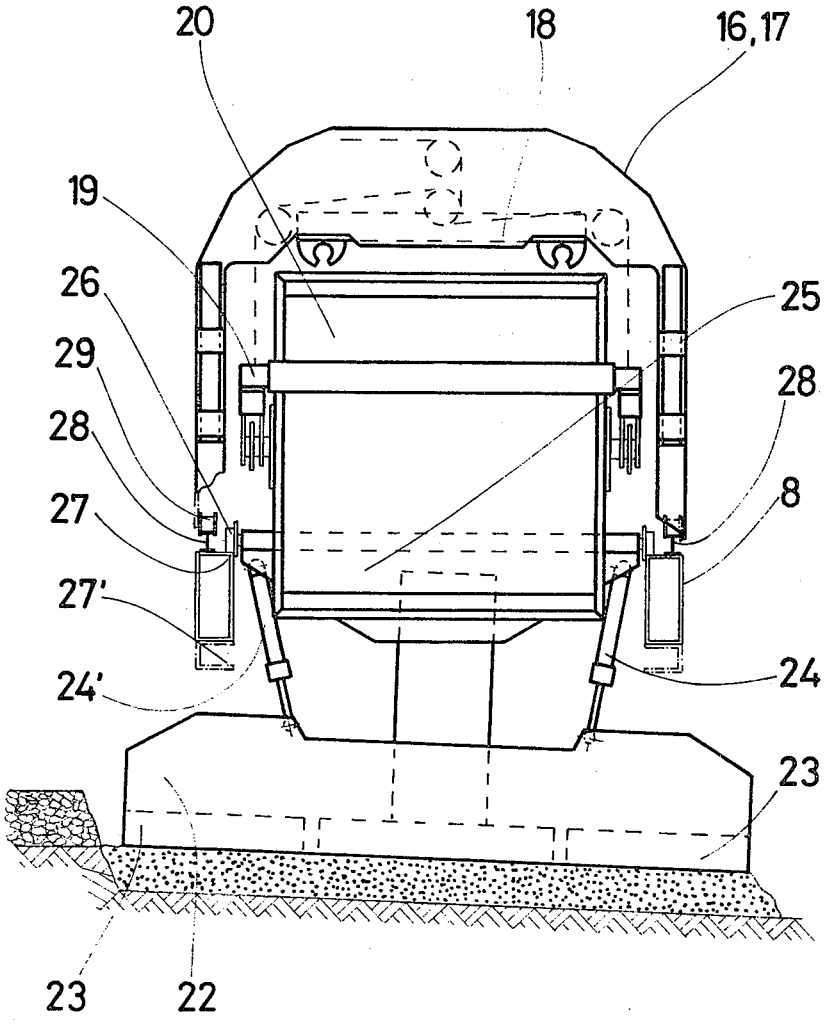
FIG. 3 is a cross section of the truck-frame shown in FIG. 2 together with a gantry and a spreading-tamping chassis.

FIGS. 2 and 3 show ancilliary equipment for the working truck 15. Provided on the sides of its empty frame 8 are tracks 28 for the gantries extending to the trucks 9 to 12 of the set of cars.

Two gantries 16 and 17 travel on this track, which gantries are equipped both with a lifting device 18 for the pieces of track 21 and a lifting and tipping device 19 for buckets 20. These gantries may thus convey full buckets over the entire length of the set of cars, over the top of the buckets in position on the trucks, tip them in order to empty them through the empty frame of the working truck and return them to the trucks carrying empty buckets.

FIG. 3 in particular shows the arrangement of the tracks 28 for the wheels 29 of gantries 16, 17. The wheels 26 of the levelling-tamping chassis 25 travel within the track for the gantries, which allows the levelling-tamping chassis to move freely whilst passing below the gantries. The wheels 26 of the levelling-tamping chassis may travel either on the upper inner edge 27 of the frame 8, as shown in FIG. 3, or on a track 27' provided below the frame 8 and illustrated in dot dash line. The leveller-tamper is composed of levelling strips 22 and tampers 23. These two members cover the entire width of the bed. They are connected to the chassis 25 through the intermediary of jacks 24 which make it possible to regulate the working depth as well as the working inclination. The working inclination may be controlled automatically by means of a pendulum.

The gantries are propelled by their own motors. On the other hand, the levelling-tamping chassis will advantageously be moved to and fro along the length of the working truck by means of a cable and a winch disposed on one of the ends of the working truck, a return pulley being disposed at the other end of this truck.

The work for improving drainage is carried out as follows:

by means of the working truck 15, the gantries 16, 17 and two conveying trucks 12 equipped with tracks, the old pieces of track are dismantled and the pieces of working track 4 are assembled;

the excavator 3 and the set of discharge rail cars 1, 2 are put in position;

the train is moved to a siding for unloading the trucks laden with old pieces of track and which will constitute the set of rail cars for improving drainage;

the old ballast is excavated with the excavator 3 and the excavated track is placed on supports;

the bed is levelled with the strip 22 and then tamped;

the sand is supplied by the gantries and buckets which are emptied through the frame of the working truck, then one proceeds with levelling and tamping of the sand;

the ballast is supplied, distributed and compacted and the pieces of track are put in position;

to finish, the complementary ballast is unloaded between the sleepers and provisional packing is carried out.

As a variation of the working method described, the equipment of the set of rail cars 2 may also be used for laying long bars previously unloaded at the sides of the track and for laying solely the sleepers.

In this variation, through the front part of the truck-frame 15, the bed is levelled, after which sand and ballast are distributed, levelled and compacted. The sleepers are laid through the rear of the open frame of the truck 15 and at the same time the long bars are placed on the sleepers as the train moves forward.

What is calimed is:

1. A railway train for use in improving the drainage of a length of railway track, comprising a first set of rail cars for travelling on the length of track to be drained, which first rail cars are equipped for excavation and evacuation of the bed of the length of track, and a second set of rail cars for travelling on track adjacent to said length, which second rail cars are equipped for conveying materials for the new bed and the new rails of the length of track and which set comprises a working truck composed of two bogies joined by an empty frame having a length which is greater than the length of a section of rail, one of the bogies being for travelling on said adjacent track and the other bogie being for travelling on said length of track, which working truck is connected to the trucks of the second set of rail cars by tracks for gantries, and two travelling gantries being provided and equipped both with a lifting device for a length of rail and a device for lifting and tipping buckets, and the working truck being equipped with a strip for levelling the bed and a tamper, these two latter pieces of equipment covering the entire width of the bed and being supported by travelling on the two side parts of the empty frame.

2. A train as claimed in claim 1, in which the levelling strip and the tamper are mounted on the same travelling chassis through the intermediary of a device for adjusting their height.

3. A train as claimed in claim 1, in which the chassis of the levelling strip and the tamper is supported by travelling on the two side parts of the working truck, the latter being provided on each side with two tracks comprising outer tracks for the gantries and inner tracks for the levelling-tamping chassis so that said chassis is able to move freely by passing below the gantries.

4. A train as claimed in claim 3, in which the outer track for the gantries is disposed in the upper part of the frame, whereas the inner track for the levelling-tamping chassis is disposed below the frame of the working track.

* * * * *